United States Patent [19]

Tunick

[11] 4,361,356

[45] Nov. 30, 1982

[54] DUAL USE CUSHION AND CONTAINER

[75] Inventor: Abraham L. Tunick, Rock Island, Ill.

[73] Assignee: Karmelkorn Shoppes, Inc., Rock Island, Ill.

[21] Appl. No.: 201,012

[22] Filed: Oct. 27, 1980

[51] Int. Cl.[3] ..... A47C 13/00

[52] U.S. Cl. ..... 297/129; 206/523; 297/118; 297/192; 297/193; 297/462

[58] Field of Search ..... 297/118, 129, 192, 193, 297/462, 461; 206/216, 541, 591, 523, 522; 190/8, 12 A

[56] References Cited

U.S. PATENT DOCUMENTS

| | | | |
|---|---|---|---|
| 469,107 | 2/1892 | Weatherly | 206/216 |
| 609,696 | 8/1898 | Nicolle | 190/12 A |
| 2,603,816 | 7/1952 | MacFarland | 297/462 X |
| 2,919,169 | 12/1959 | Jackson | 297/193 X |
| 3,114,574 | 12/1963 | Pryale | 297/193 |
| 3,751,845 | 8/1973 | Van Leevwen | 297/462 X |
| 3,773,170 | 11/1973 | Rossi | 206/216 |
| 4,087,002 | 5/1978 | Bambara | 206/523 |
| 4,295,680 | 10/1981 | Grasso | 297/193 |
| 4,308,952 | 1/1982 | Paulacci | 206/216 |

*Primary Examiner*—James T. McCall
*Attorney, Agent, or Firm*—Gary, Juettner & Pyle

[57] ABSTRACT

A dual use cushion and container are provided and adapted for a first use with a shipping carton. The container has a cover or lid at the top and a handle on the side. The cushion includes a retaining tab and can be folded so that it can be placed within the shipping carton along side the container. When in the shipping carton, the cushion cushions the container during shipment. After shipment, the cushion and container can be removed from the shipping carton, and the cushion placed on top of the lid of the container to form a cushioned seat. The retaining tab of the cushion can be engaged with the handle of the container to hold the cushion in place on top of the container's lid. In addition to its use in holding the cushion in place on top of the seat, the handle can be used to carry the container.

9 Claims, 3 Drawing Figures

DUAL USE CUSHION AND CONTAINER

This invention relates to a dual purpose cushion and container, and more particularly to a cushion and container which may be used in conjunction with a shipping carton, and after shipment the cushion may be placed and held on top of the container to form a cushioned seat.

SUMMARY OF THE INVENTION

The dual use cushion and container of the present invention are adapted for use in a first mode with a shipping carton for shipment of the container. The container has a lid or access opening and at least one handle at its side. The cushion itself comprises a body, or first portion, formed by an outer cover extending over cushioning material and a retaining tab, or second portion, having an opening therein adapted to cooperate with the handle of the container. In the first mode of use, the dual use cushion acts as a product or shipping cushion, cushioning the container in the carton during shipment. For shipment, the container and its contents are placed in the carton, and the cushion is placed between the carton and container to cushion the latter by taking up the free space between one area of the carton and container. After shipment, the container and the cushion are removed from the carton.

In the second mode of use, the cushion is placed atop the lid closing the container to form a cushioned seat. To retain the cushion in position, its retaining tab is folded over the side of the container and engaged with the handle of the container to hold the cushion in place.

One object of the dual use cushion and container of the present invention is to provide both a shipping package and a cushioned seat.

Another object of the dual use cushion and container of the present invention is to provide a cushion and container construction which can be used for shipping in a carton and then removed and the cushion held in place on the container to provide a cushioned seat.

These and other objects of the present invention will become apparent from the following written description and the accompanying figures of the drawings wherein:

DESCRIPTION OF THE PREFERRED EMBODIMENT

Figure 1:
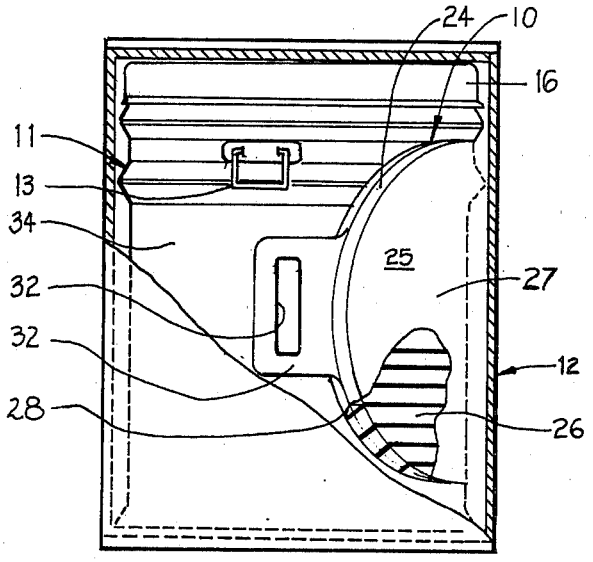
FIG. 1 is an elevational view of a dual use cushion and container of the present invention shown in a first mode with a shipping carton, portions of the cushion and carton being broken away to better illustrate the invention.

Referring to FIG. 1, the dual use cushion 10 and cylindrical container 11 of the present invention are shown placed in a conventional shipping carton 12. The container 11 has, preferably, a pivotally mounted handle 13 on either side. The handle itself has a sheet metal base 15 which is secured to the container 11 by conventional means, such as screws. The actual hand engaging portion of the handle in turn is secured to its base 15, as by bent tangs or tabs 17. The top of the container 11 is closed by a separate, circular access cover or lid 14 having a perpendicularly downwardly extending perphiral lip 16 which engages with a similar but smaller diameter lip on the lower portion of the container 11.

Figure 2:
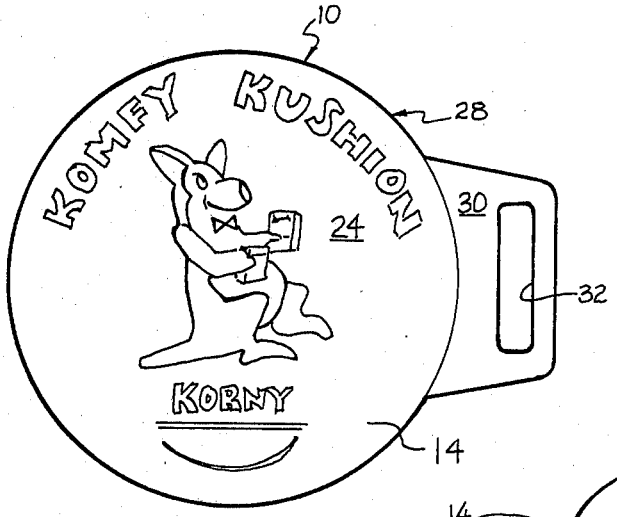
FIG. 2 is a plan view of the cushion shown in FIG. 1.

The cushion 10 is more fully shown in FIG. 2, and in this instance comprises upper and lower cover pieces 24 and 25 made of a suitable cloth-like material, such as vinyl. The upper and lower cover pieces 24 and 25 extend over a resilient or elastic material 26, as for example, foam rubber to form the body or seat portion 27 of the cushion. The cover is provided with air holes (not shown) to permit the escape of air trapped under the cover when the cushion is compressed. As shown, the two pieces 24 and 25 may be sewn together along an intermediate seam 28 to enclose the elastic material 26. The pieces 24 and 25 form an extension or retaining tab 30 extending several inches off toward one side. An elongated opening 32 is provided in the retaining tab 30. As will be described, the retaining tab 30 is of sufficient length and width so that the opening 32 will extend over one of the handles 13 of the container 11 when the cushion 10 is used in a second mode. The size of the retaining tab 30 and opening 32 depend upon the placement and size of the handle of the container, as will become apparent, the opening 32 in the retaining tab 30 being spaced away from the edge of the seat portion of the cushion substantially the same distance the handle 13 is spaced from the edge of the cover 14.

In the first mode of use, the cushion 10 and container 11 are used to ship a product in container 11, both the cushion 10 and container 11 being contained in the shipping carton 12. Container 11 may be filed with the product to be shipped. After the container 11 is filled and closed, it and the cushion 10 may be slipped into the carton 12 substantially as shown in FIG. 1. In this mode the cushion 10 helps cushion the product in the container 11.

After the cushion 10 and container 11 are shipped in the carton 12 to their destination, and the cushion 10 and container 11 have fulfilled their product cushioning function, the cushion and the container can be removed from the carton.

Figure 3:
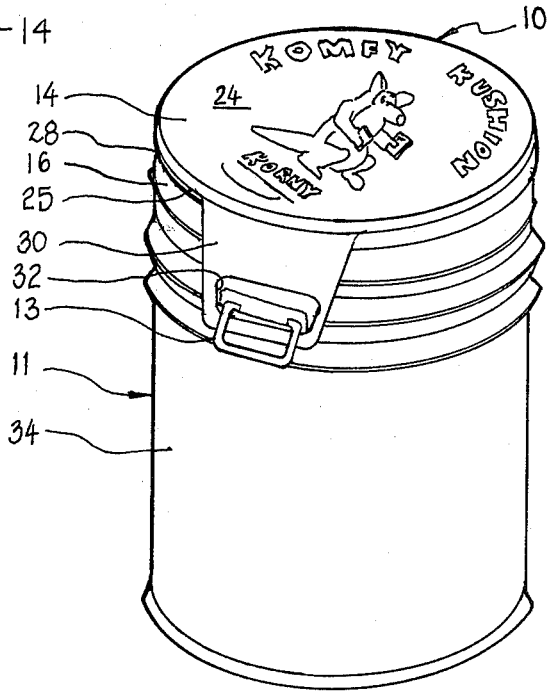
FIG. 3 is a perspective view of the cushion and container shown in FIG. 1 in a second mode of use, with the cushion mounted on top of the container to form a cushioned seat.

Referring to FIG. 3, in the second mode the removed cushion 10 may be placed on top of the lid 14 of the closed container 11 to form a cushioned seat. As is shown in FIG. 3, to retain the cushion 10 in place, the retaining tab 30 is folded down over the cylindrical side wall 34 of the container 11 so that the opening 32 in the retaining tab is located generally over one of the pivotally mounted handles 13. That handle 13 is then pivoted upwardly through the opening 32 and then bent downwardly again to hold the retaining tab 30, and hence the cushion 10, in place on the lid of the container 11. Such cushioned seat may be used at picnics, sporting events, etc. Also, even after the original contents of the container are consumed, the interior of the container is useable for carrying various items, such as lunches, blankets, etc., as may be desired.

It should be appreciated the dual use cushion and container of the present invention could have taken different form. For example, the cushion could have been made of a single piece of material forming both the outer cover and the resilient portion. Also, instead of being used between the carton and container, the cushion could be installed within the container to cushion the contents inside the container. If the cushion is to be placed within the container, the cushion and container will have similar dimensions. Of course, the handle of the container need not pivot, but could instead be fixed. In such case, the opening 32 would be first slipped over the handle. While only the preferred embodiment has been illustrated, it is contemplated that modifications and variations thereof could be made and such would fall within the scope of the appended claims:

What is claimed is:

1. A dual use cushion and container, comprising a container having a flat top portion spaced above its bottom and at least one handle, and a cushion having a flexible seat portion substantially as large as the top of said container, said cushion having a retaining tab extending to one side of said seat portion, said retaining tab having an opening for cooperating with said handle to hold said cushion on top of said container, said cushion and container having first positions with said cushion adjacent said container, said cushion and container when in said first position being adapted to be placed within a shipping carton for shipment of a product in said container and said cushion cushioning said container for shipment, and after shipment said cushion and container having second positions with said cushion placed on top of said container to provide a cushioned seat, said retaining tab being movable to a position with said opening therein adjacent said handle, said retaining tab being engageable with said handle to hold said cushion in place on top of said container, whereby said cushion and container can be used for shipping and after shipping to form a cushioned seat.

2. A dual use cushion and container, comprising a container having a removable lid at the top and at least one pivotable handle at its side, a cushion having a seat portion, and a foldable retaining tab portion extending to one side of said seat portion, said retaining tab having an opening for cooperating with said handle to hold said cushion in place on the top of said lid of said container, said opening in said retaining tab being of a width and length adapted to receive said handle, said opening in said retaining tab being located substantially the same distance from said seat portion of said cushion as said handle is from said lid closing said container, said cushion and container having first positions adjacent one another with said cushion functioning as a shipping cushion during shipment, after shipment said cushion and container having second positions with said cushion on top of said lid closing said container to provide a cushioned seat, said retaining tab being folded over the side wall of said container and perpendicularly to said seat portion with said opening in said retaining tab being juxtaposed said handle, said retaining tab and said handle being engageable with each other, said handle being passable through said opening in said retaining tab and being pivotable to hold said retaining tab and cushion in place on said lid of said container.

3. A dual use cushion and container as in claim 1, wherein said opening in said retaining tab is of a width and length substantially equal to or greater than the length and width of said handle, and said opening being located substantially the same distance from said seat portion of said cushion as said handle is from the top of said container.

4. A dual use cushion and container as in any of claims 1 or 2, wherein said seat portion further comprises two cover pieces joined together along a seam, and resilient material enclosed within said cover pieces, and said retaining tab being formed by extensions of said two cover pieces.

5. A dual use cushion and container as in claim 4, wherein said resilient material is foam rubber, and said cover pieces are cloth-like vinyl.

6. A dual use cushion and container as in claims 1 or 2, wherein said handle further comprises a base secured to said container, said handle being in turn secured to said base.

7. A dual use cushion and container as in claims 1 or 2, wherein said container is adapted to be shipped within a carton, and said cushion being placeable between said carton and container.

8. A dual use cushion and container as in any of claims 1 or 2, wherein said cushion is placeable within said container to cushion a product inside said container.

9. A dual use cushion and container as in claim 2, wherein said resilient material is foam rubber, and said cover pieces are cloth-like vinyl.

* * * * *